United States Patent [19]

Chase

[11] Patent Number: 4,524,353

[45] Date of Patent: Jun. 18, 1985

[54] LINE PATTERN TEMPLATE GENERATOR

[75] Inventor: Karl L. Chase, Glendale, Ariz.

[73] Assignee: Sperry Corporation, New York, N.Y.

[21] Appl. No.: 362,818

[22] Filed: Mar. 29, 1982

[51] Int. Cl.[3] ..... G09G 1/08

[52] U.S. Cl. ..... 340/732; 340/739

[58] Field of Search ..... 340/732, 734, 736, 739, 340/740, 797, 799

[56] References Cited

U.S. PATENT DOCUMENTS

| | | | |
|---|---|---|---|
| 2,910,681 | 10/1959 | Yoshiharu | 340/743 X |
| 3,555,538 | 2/1967 | Henderson et al. | 340/737 |
| 3,569,951 | 3/1971 | Lavenir | 340/740 |
| 3,597,757 | 8/1971 | LaSapinere | 340/740 |
| 3,742,484 | 6/1973 | Rosenthal | 340/739 |
| 3,936,664 | 2/1976 | Sato | 340/732 X |
| 4,291,305 | 9/1981 | Kimura et al. | 340/734 |
| 4,295,135 | 10/1981 | Sukonick | 340/734 |
| 4,396,989 | 8/1983 | Fleming et al. | 340/739 X |
| 4,445,114 | 4/1984 | Stubben | 340/734 X |

*Primary Examiner*—Marshall M. Curtis
*Assistant Examiner*—Vincent P. Kovalick
*Attorney, Agent, or Firm*—Howard P. Terry; Albert B. Cooper

[57] ABSTRACT

Line patterning apparatus for use with a vector generator comprises a memory storing a plurality of addressable line pattern bit strings. Each string comprises a series of ones and zeros defining a predetermined pattern of dots and/or dashes. Associated with each pattern string is a pattern restart string defining the length of the pattern. The bits of an addressed pattern string and the associated pattern restart string are serially provided by the memory in response to an addressing counter. The bits of the pattern string are utilized for video inhibition to superimpose the pattern on a vector being generated. The bits of the pattern restart string are utilized to clear the counter when a preset restart bit is encountered in the string by the counter.

9 Claims, 2 Drawing Figures

LINE PATTERN TEMPLATE GENERATOR

BACKGROUND OF THE INVENTION

1. Field of the Invention

The invention relates to synthetically generated displays and particularly to cathode ray tube displays utilizing stroke writing or raster techniques. The invention also relates to other display technologies such as X-Y plotters.

2. Description of the Prior Art

Synthetically generated displays utilizing, for example, cathode ray tubes (CRT) are known in the art where the display is generated by stroke or calliographic techniques or by raster techniques. A stroke writing CRT display provides synthetic images by deflecting the electron beam so as to draw the shape of the figures to be presented. Raster displays provide an image by generating a pattern of raster scan lines with the image created by illuminating the beam at appropriate points along the raster lines. Vector generation apparatus is utilized in such displays to provide straight line vectors which are concatenated and combined to provide straight or curved line segments of varying positions, directions and lengths to create complex images. The complete display image may be difficult to interpret by a human viewer because of the complexity of the image and because of the close proximity of unrelated symbols or vectors which tend to obscure each other and be confused with one another. For example, complex topographical and tactical maps comprising, for example, roads, rivers, railroads, and designated air spaces and lanes may tend to be difficult to interpret by a viewer.

Interpretation of displayed images may be enhanced by drawing different classes of vectors and lines in a distinguishing manner. The lines may be altered with distinctive dot and dash patterns. For example, lines representing roads may be dashed to distinguish them from lines representing rivers with railroads depicted with a special dashed pattern. Restricted air spaces or air lanes may be further distinguished with other dot and dash patterns. The patterns may comprise any combination of dots, short dashes, long dashes and the like.

In the prior art dashed and dotted lines have been generated by controlling the vector generator to provide a large number of individual concatenated vectors with each dot, each dash and each space requiring a separate vector. The groups of generated vectors are then interpreted by the viewer as dashed or dotted lines.

The prior art method of patterning vectors and lines has several disadvantages. The combined effect of numerous small vectors may not accurately provide the desired total vector direction and length because of round-off or truncation errors associated with each individual small vector. Additionally, the instructions given to the vector generator by the controlling mechanism (such as a microprocessor) are more numerous when generating a plurality of small vectors, thus resulting in the controlling mechanism devoting excessive time and resources to servicing the vector generator. Additionally, a dashed vector in the prior art may take longer to draw than a solid vector because of inefficiencies in initializing numerous vectors.

A vector generator of the type discussed above is described in copending U.S. patent application Ser. No. 354,972, filed Mar. 5, 1982, entitled "Display Vector Generator Utilizing Sine/Cosine Accumulation" by the present inventor and assigned to the assignee of the present application. A stroke writing display of the type discussed above is disclosed in Applicant's Assignee's U.S. Pat. No. 4,115,863, issued Sept. 19, 1978 to Richard R. Brown, entitled "Digital Stroke Display with Vector, Circle and Character Generation Capability". Vector images may also be portrayed utilizing a raster displayed by drawing a vector image into a large memory in which the memory bits correspond to the points, respectively, of the CRT display face. A stroke generator utilizing digital X and Y coordinates may be utilized to write the vector image into the memory by addressing the memory with the X and Y coordinate information and storing the corresponding video at the memory locations. The memory is thereafter addressed by a digital raster generator for providing the CRT video for generating the vector image. A digital raster display generator is disclosed in Applicant's Assignee's U.S. Pat. No. 4,070,662, issued Jan. 24, 1978.

SUMMARY OF THE INVENTION

The above-described disadvantages of the prior art devices are obviated by line patterning apparatus for use with a vector generator that includes line generation control means. In a CRT vector generator the line generation control means would comprise the video control of the CRT. The invention comprises means for storing at least one string of digits arranged in a pattern and means for serially applying the digits of the string to the line generation control means so as to pattern the line in accordance with the pattern. Preferably, a plurality of pattern strings of digits are stored with means for addressing the strings so as to apply various predetermined patterns to the lines of the image.

DESCRIPTION OF THE PREFERRED EMBODIMENT

Figure 1:
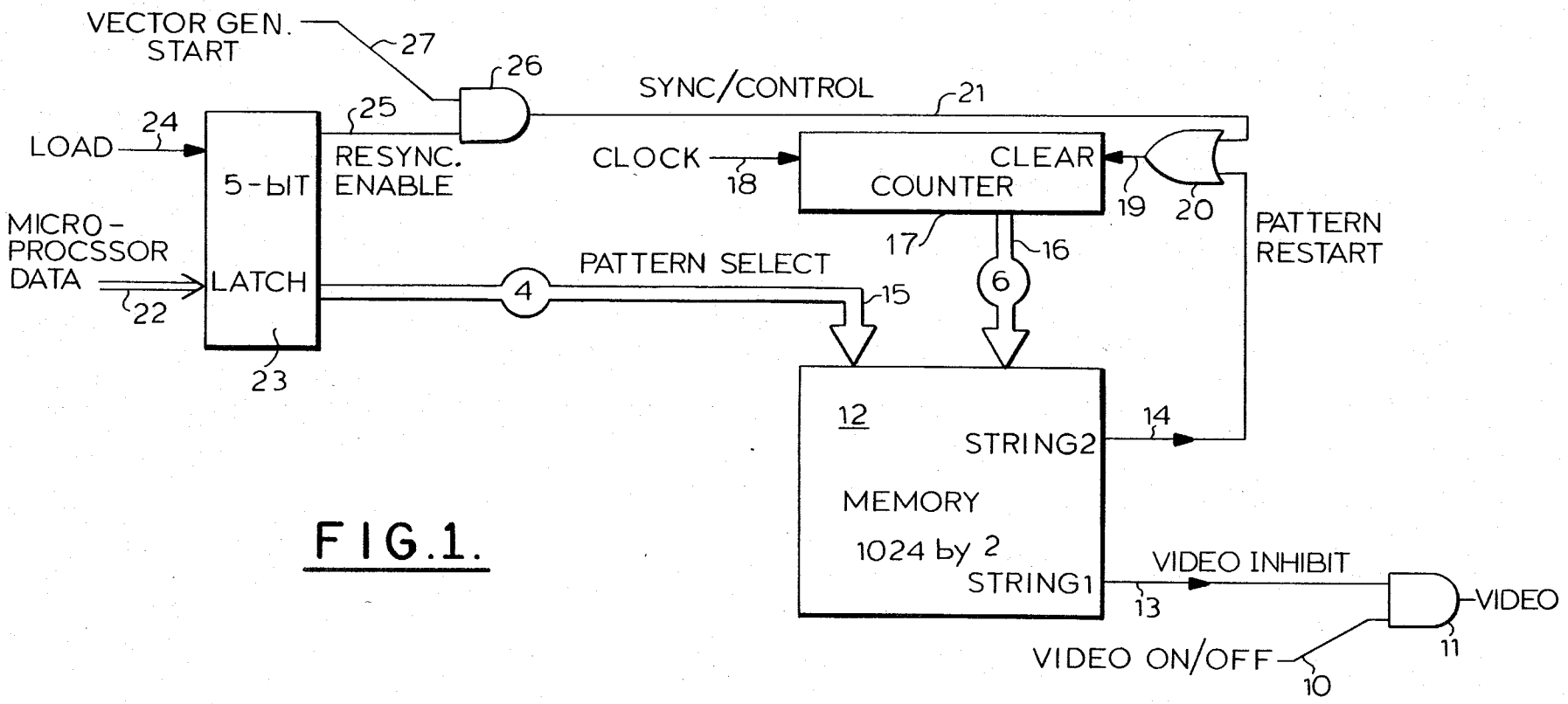
FIG. 1 is a schematic block diagram of the line patterning apparatus constructed in accordance with the present invention.

Referring to FIG. 1, line patterning apparatus programmed to provide a selected one of several dot and/or dash patterns in synchronization with a vector generator is illustrated. The patterns comprising dots as well as long and short dashes are superimposed on the vectors drawn by the vector generator. Vector generators of the type discussed above may be utilized in practicing the invention. A video on/off signal applied to a lead 10 is the video signal from the vector generator. The video on/off signal operates in conjunction with the X and Y deflection voltages of the vector generator providing video enablement when the deflection starts and video disablement when the deflection stops. The video on/off signal on the lead 10 is applied as an input to an AND gate 11 which provides the video signal to the display CRT. In displays utilizing technologies other than cathode ray tubes, such as X-Y plotters, the output of the AND gate 11 may be utilized to control the line generation control means of the display. For example, the output of the AND gate 11 may enable the pen writing means of an X-Y plotter.

The patterning apparatus of FIG. 1 includes a memory 12 for storing the patterns. By way of example, the memory 12 stores a set of 16 patterns, each comprising two 64 bit strings, one string storing the pattern and the other string providing a stop bit for string length control. For example, String 1 1111100011111000 . . .

String 2 0000000000000001 . . .

Figure 2:
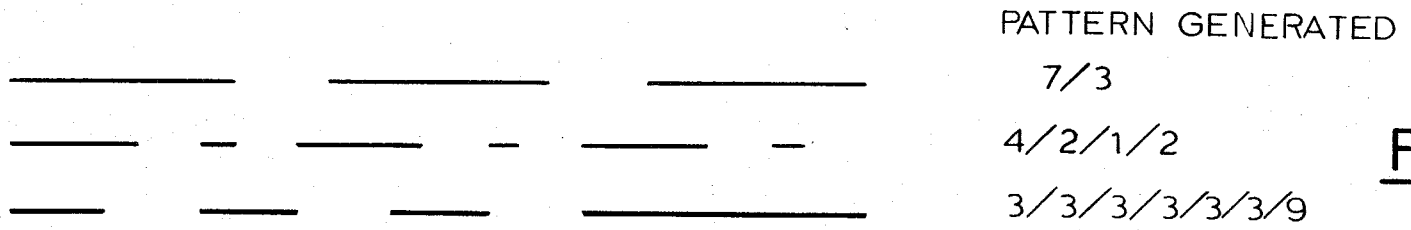
FIG. 2 is a diagram illustrating a variety of patterns.

String 1 is utilized for video inhibit control and string 2 provides string length control via the stop bit. String 2 generally has only a single bit set to determine the length of the pattern. String 1 may have any pattern among its 64 bits - dots and/or long or short dashes. The bits beyond the string 2 stop bit are not utilized. String 1 is utilized repetitively up to the stop bit of string 2. FIG. 2 illustrates typical patterns that may be stored in the memory 12.

The memory 12 may, for example, be two bits wide storing 1,024 words. Each of the sixteen patterns stored in the memory 12 may be stored in 64 consecutive memory locations, the first bit of the 64 words comprising the pattern string 1 and the second bit of the 64 words comprising the stop bit string 2. The string 1 bits of sequentially addressed words are provided on an output lead 13 of the memory 12 with the string 2 bits provided on a memory output lead 14. The lead 13 is coupled as an input to the AND gate 11 thus providing video inhibit control. When the bits of string 1 are serially applied to the AND gate 11, the binary ONE bits enable the video and the binary ZERO bits inhibit the video, thus turning the video on and off in accordance with the template pattern stored in the addressed words as the associated vector generator generates a vector. It is therefore appreciated that the vector is drawn as a dotted and/or dashed vector in accordance with the addressed pattern.

The 1,024 words of the memory 12 are addressed by a ten bit address input comprising four pattern select bits on a bus 15 and six additional bits on a bus 16. The four bits on the bus 15 address one of the sixteen groups of 64 words storing the respective patterns and sequential six bit addresses from 0 to 63 on the bus 16 sequentially address the 64 words of the selected pattern.

The address sequence on the bus 16 is provided by a six bit counter 17 providing sequential counts from 0 to 63 on the bus 16 in response to a clock signal on a lead 18. The clock signal on the lead 18 is provided by the vector generator clock that controls the CRT deflection. The counter 17 may be cleared to zero by a pulse on a clear input lead 19. The string 2 bits on the lead 14 are applied via an OR gate 20 to the lead 19. Thus, as the counter 17 is sequencing through the words of an addressed pattern, the counter 17 is cleared back to zero when the stop bit in string 2 is provided to the clear input lead 19 of the counter. It is thus appreciated that the position in which the stop bit is set in string 2 controls the length of the generated pattern. The counter 17, therefore, sequences along the string 1 - string 2 pattern by generating the addresses on the bus 16 from: 0 to 63 or 0 to the stop bit in a repetitive fashion. The line patterning apparatus of the present invention, therefore, may repetitively pattern sequences of vectors in accordance with the pattern selected by the address on the bus 15.

The memory 12 may comprise a ROM with fixed patterns or a RAM in which patterns may be altered while the equipment is operating. If the memory 12 is implemented as a RAM, patterns are loaded when the vector generator is not operating. The memory 12 may also be fabricated as a PROM or as any other type of memory, commercially available or otherwise. Although the memory 12 was exemplified as having a 1,024×2 configuration, the memory may also be fabricated utilizing a 512 by 4 memory with a 4-to-2 selector at the output. The five most significant bits of the counter 17 would then be utilized as described above with the least significant bit utilized to control the memory output selector.

It is usually desirable to start a pattern at the beginning thereof when a vector is started. Accordingly, a sync/control pulse on a lead 21 is utilized to clear the counter 17 when the vector deflection starts. At other times, it may be desirable to continue the pattern from one vector to another, in which case the pulse on the lead 21 is omitted.

The patterning apparatus of FIG. 1 may be included as part of a larger display system utilizing microprocessor control. The microprocessor (not shown) provides five bit control data on a bus 22 to a five bit latch 23. The data on the bus 22 is loaded into the latch 23 under control of a load signal applied on a lead 24. The five bit data loaded into the latch 23 comprises the four bit pattern select address that is transmitted on the bus 15 as well as a resync enable signal provided by the latch 23 on a lead 25. The resync enable signal on the lead 25 provides the sync/control pulse on the lead 21 via an AND gate 26. A lead 27 provides a second input to the AND gate 26 and receives a vector generator start pulse from the associated vector generator with which the patterning apparatus of FIG. 1 is utilized.

Before the vector generator starts, the microprocessor loads the four bit pattern select address as well as the resync enable bit into the latch 23. If the pattern to be generated is to be synchronized to the start of a vector, the resync enable signal on the lead 25 is high. If the pattern is not to be resynchronized, the bit on the lead 25 is low. Thus, when the vector generator starts and provides the start pulse on the lead 27, this pulse is only transmitted through the AND gate 26 to clear the counter 17 when the resynch enable bit on the lead 25 is set.

Thus, selected line patterns may be utilized to enhance displayed lines with a variety of dot and dash patterns. The repetition length and the pattern detail are limited only by the resolution of the common clock utilized by the apparatus of FIG. 1 and the associated vector generator. The invention enhances the information provided on a CRT display, an X-Y plotter display and the like. The present invention improves the legibility and facilitates the comprehension of synthetic displays constructed from straight or curved line segments of varying lengths and position. Since the specified pattern may be resynchronized with the start of a vector or may be continuous from vector to vector, the invention may be utilized with any line, conic, character or symbol.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. Patterning apparatus for patterning solid lines generated by a vector generator, said vector generator having line generation control means for enabling the generation of said solid lines, said patterning apparatus patterning said lines into a plurality of predetermined and selectable patterns, said patterning apparatus comprising addressable memory means for storing a plurality of strings of digits arranged in said plurality of predetermined patterns, respectively, means for selecting one of said strings of digits, thereby selecting one of said predetermined patterns, and means for serially applying the digits of said selected string to said line generation control means simultaneously with the generation of said solid lines by said vector generator for alternately enabling and disabling the generation of said solid lines in accordance with the digits of said selected string so as to pattern said solid lines in accordance with said selected pattern, said memory further storing a further plurality of strings of digits associated respectively with said plurality of strings of digits storing said patterns, each string of said further plurality of strings comprising a string of digits including a stop bit thereby defining a stop bit string.

2. The patterning apparatus of claim 1 in which said selecting means comprises first addressing means for addressing said selected string of digits.

3. The patterning apparatus of claim 2 in which said serially applying means comprises second addressing means for sequentially addressing the locations of said memory means storing the digits of said selected string so as to serially provide the digits of said selected string to said line generation control means.

4. The patterning apparatus of claim 3 in which said second addressing means comprises a counter for providing a sequence of addresses to said memory thereby sequentially addressing the locations of said digits of said selected string.

5. The patterning apparatus of claim 4 further including means for clearing said counter thereby initiating the sequential addressing of a string at the first digit thereof.

6. The patterning apparatus of claim 5 in which said first and second addressing means addresses the stop bit string associated with said selected string of pattern digits thereby serially providing the digits of the selected stop bit string.

7. The patterning apparatus of claim 6 including means for providing the digits of the selected stop bit string to said counter thereby clearing said counter in response to said stop bit for controlling the length of said pattern.

8. The patterning apparatus of claim 7 in which said line generation control means comprises the video control of said vector generator.

9. The patterning apparatus of claim 7 further including means for providing a synchronizing signal to said counter for clearing said counter.

* * * * *